US010533391B2

(12) United States Patent
Chen

(10) Patent No.: US 10,533,391 B2
(45) Date of Patent: Jan. 14, 2020

(54) REDUCING SUPPORT RING FOR BRIDGE PLUG AND BRIDGE PLUG

(71) Applicant: Aimin Chen, Beijing (CN)

(72) Inventor: Aimin Chen, Beijing (CN)

( * ) Notice: Subject to any disclaimer, the term of this patent is extended or adjusted under 35 U.S.C. 154(b) by 196 days.

(21) Appl. No.: 15/718,843

(22) Filed: Sep. 28, 2017

(65) Prior Publication Data

US 2018/0094502 A1 Apr. 5, 2018

(30) Foreign Application Priority Data

Sep. 30, 2016 (CN) ..... 2016 1 0868106

(51) Int. Cl.

| | |
|---|---|
| ***E21B 23/06*** | (2006.01) |
| ***E21B 33/128*** | (2006.01) |
| ***E21B 33/129*** | (2006.01) |
| ***E21B 33/134*** | (2006.01) |
| ***C22C 21/06*** | (2006.01) |
| ***C22C 23/02*** | (2006.01) |
| *E21B 29/00* | (2006.01) |

(52) U.S. Cl.

CPC ..... *E21B 33/1292* (2013.01); *C22C 21/06* (2013.01); *C22C 23/02* (2013.01); *E21B 23/06* (2013.01); *E21B 33/128* (2013.01); *E21B 33/134* (2013.01); *E21B 29/00* (2013.01)

(58) Field of Classification Search

CPC ..... E21B 23/06; E21B 29/00; E21B 33/128; E21B 33/1292; E21B 33/134; C22C 21/06; C22C 23/02

See application file for complete search history.

(56) References Cited

U.S. PATENT DOCUMENTS 4,646,829 A * 3/1987 Barrington ..... E21B 23/006 166/125
5,224,540 A 7/1993 Streich et al.
5,271,468 A 12/1993 Streich et al.
(Continued)

FOREIGN PATENT DOCUMENTS

CN 202194615 U 4/2012
CN 203925413 U 11/2014
(Continued)

OTHER PUBLICATIONS

"Aluminum Alloys—Yield and Tensile strength" webpage, 2pgs. https://www.amesweb.info/materials/aluminum-yield-tensile-strength.aspx. retrieved Jun. 2019 (Year: 2019).*

*Primary Examiner* — Daniel P Stephenson
(74) *Attorney, Agent, or Firm* — The Webb Law Firm

(57) ABSTRACT

A reducing support ring for a bridge plug and a bridge plug for sealing or packing boreholes or wells. The reducing support ring for the bridge plug includes a ring-shaped body with a setting surface provided on a circumferential outer wall or end face of the ring-shaped body. Deformation of the ring-shaped body under an axial compression force allows the setting surface of the ring-shaped body to be abutted against and positioned on an inner wall of a sleeve where a bridge plug is located and to form a surface contact-type sealed connection with the inner wall of the sleeve. The bridge plug includes the reducing support ring. The reducing support ring and the bridge plug improve the plugging effect and anchoring performance of the bridge plug and the convenience of construction.

18 Claims, 7 Drawing Sheets

(56) References Cited

U.S. PATENT DOCUMENTS

| | | | | |
|---|---|---|---|---|
| 5,390,737 | A | 2/1995 | Jacobi et al. | |
| 8,469,088 | B2 * | 6/2013 | Shkurti | E21B 33/134 166/138 |
| 2004/0216868 | A1 * | 11/2004 | Owen, Sr. | E21B 23/06 166/134 |
| 2010/0132960 | A1 | 6/2010 | Shkurti et al. | |
| 2011/0048740 | A1 * | 3/2011 | Ward | E21B 33/134 166/381 |
| 2011/0048743 | A1 | 3/2011 | Stafford et al. | |
| 2014/0196913 | A1 * | 7/2014 | Pedersen | E21B 33/1293 166/386 |
| 2016/0032682 | A1 * | 2/2016 | Sommers | E21B 33/1293 166/135 |
| 2016/0138363 | A1 * | 5/2016 | Sommers | E21B 23/06 166/387 |
| 2018/0094502 | A1 * | 4/2018 | Chen | C22C 21/06 |

FOREIGN PATENT DOCUMENTS

| | | | |
|---|---|---|---|
| CN | 104612624 | A | 5/2015 |
| CN | 204492751 | U | 7/2015 |
| CN | 206220920 | U | 6/2017 |
| EP | 0570157 | B1 | 1/1998 |

* cited by examiner

REDUCING SUPPORT RING FOR BRIDGE PLUG AND BRIDGE PLUG

CROSS-REFERENCE TO RELATED APPLICATION

This application claims priority to Chinese Patent Application No. 201610868106.2 filed Sep. 30, 2016, the disclosure of which is hereby incorporated in its entirety by reference.

FIELD OF THE INVENTION

The present application relates to the technical field of sealing or packing boreholes or wells, and in particular to a reducing support ring for a bridge plug and a bridge plug using the reducing support ring.

BACKGROUND OF THE INVENTION

In the exploration and development of an oilfield, as required by technologies such as zonal testing, zonal and staged fracturing or zonal and staged production test for production zones of oil, gas and water wells, a temporary plugging process must be adopted to plug a current production zone and cut off the flowing channel of the production zone in a shaft, thereby facilitating implementation of process measures to other production zones. The temporary plugging is cancelled after the completion of the process, and the flowing channel between the production zone and the shaft is established for oil extraction and gas production on oil and gas wells.

As the most economic and effective shaft plugging technology at present, and also the most extensively used technology in shaft operation, measure innovation, and formation testing and production testing technologies, plugging with a bridge plug is one of the most extensively used processes during exploration, development and production of oil fields. However, the applicant has found that at least the following technical problems exist in a bridge plug as shown in FIG. 1 provided by the prior art. Firstly, the issue of midway setting influences normal use; regardless of a foreign product or a domestic product, the issue of midway setting frequently happens in the process of running of the bridge plug due to free movement of a bridge plug running tool and release setting of a bridge plug. Once midway setting occurs, recovery or drilling removal treatment needs to be carried out, which influences the period and costs of construction.

Secondly, recovery or plug drilling is high in cost and difficulty; restrictive conditions (e.g., settled sand, dropping objects, and well wall scale) in a shaft during plug drilling lead to more difficult plug drilling, and the shaft thus needs to be treated in advance through other processes, leading to increase in costs of construction, and even leading to complex conditions in the shaft with an influence on normal production of oil and gas wells; additionally, during plug drilling, regardless of a drillable bridge plug or a composite easy-drilling bridge plug, the drilling removal of the bridge plug itself needs a ground power system with high costs of construction on the one hand, and on the other hand, the slips of the bridge plug itself are made from a high-strength material with extremely poor drilling grindability, which becomes the most difficulty in plug drilling; the slip blocks also easily cause the issue of blockage of a plug drilling pipe column, dramatically increasing the costs of the whole plug drilling process.

Thirdly, the existing bridge plug is unstable in plugging effect after setting; the reason is that a leaking channel exists between a rubber cylinder of the bridge plug and the well wall, and the bridge plug loses its importance of plugging, resulting in unclear directions where a fracturing fluid goes and causing serious waste.

Fourthly, the bridge plug is unreliable in anchoring after setting, and goes down during fracturing, leading to a failure in zoning and having great influence on the quality of zonal fracturing construction.

Fifthly, the cage of the bridge plug cannot be adjusted in the construction site, which is inconvenient for fracturing construction.

Sixthly, the elastic sealing cylinder of the bridge plug are made from degradable rubber and degradable polymer materials, whereas the degradable rubber and the degradable polymer materials are not temperature resistant and fail in satisfying the application environments of high compressive strength; when degradable paper, degradable plastics and an imitation metal degradable material in industrial production and daily life are used for making the bridge plug, since these materials have restrictions in application range and condition in nature and are extremely low in strength, which can be only 30%-40% of the strength of a common carbon steel metal material, the bridge plug made from such materials fails in satisfying the application environments of high compressive strength in the mine field.

SUMMARY OF THE INVENTION

At least one objective of the present application is to provide a reducing support ring for a bridge plug and a bridge plug using the reducing support ring, solving the technical problem of unstable plugging effect in the prior art. Many technical effects (lasting and stable plugging effect, good anchoring reliability, avoidance of midway setting, no requirement on plug drilling, convenient construction and the like) which can be produced by preferred technical solutions among many technical solutions provided by the present application will be described in detail below.

In order to achieve the above objective, the present application provides the following technical solutions.

The reducing support ring for a bridge plug provided by the present application includes a ring-shaped body, wherein a setting surface is provided on circumferential outer wall or end face of the ring-shaped body. A deformation of the ring-shaped body under the action of an axial compression force allows the setting surface of the ring-shaped body can be abutted against and positioned on an inner wall of a sleeve where the bridge plug is located, and forms surface contact-type sealed connection with the inner wall of the sleeve (or the well wall if conditions allow).

As the optimization of any technical solution or any optimized technical solution provided by the forgoing or later descriptions of the present application, the reducing support ring includes a first ring-shaped body and a second ring-shaped body overlapping each other, wherein a first setting surface is provided on a circumferential outer wall or an end face of the first ring-shaped body and a second setting surface is provided on a circumferential outer wall or an end face of the second ring-shaped body; the deformations of the first ring-shaped body and the second ring-shaped body under the action of an axial compression force allow the first setting surface of the first ring-shaped body and the second setting surface of the second ring-shaped body to be abutted against and positioned on the inner wall of the sleeve where the bridge plug is located, and to form the surface contact-type sealed connection with the inner wall of the sleeve.

As the optimization of any technical solution or any optimized technical solution provided by the forgoing or later descriptions of the present application, the first setting surface and/or the second setting surface are/is a conical surface or a curved surface before the first ring-shaped body and the second ring-shaped body are compressed.

As the optimization of any technical solution or any optimized technical solution provided by the forgoing or later descriptions of the present application, respective sections of the first ring-shaped body and the second ring-shaped body, sleeving an elastic sealing cylinder of the bridge plug, are provided with at least two gaps, or at least two weak areas which are split to form gaps after the first ring-shaped body and the second ring-shaped body are compressed;

wherein each section is divided by the respective gaps into at least two forked branches provided in a circumferential direction, and the first setting surface and/or the second setting surface are/is located on circumferential outer walls or end faces of the forked branches; and the gaps or weak areas in the first ring-shaped body and the gaps or weak areas in the second ring-shaped body are staggered with each other in the circumferential direction.

As the optimization of any technical solution or any optimized technical solution provided by the forgoing or later descriptions of the present application, each gap or weak area in the first ring-shaped body is located at a central position in the circumferential direction between two adjacent gaps or weak areas in the second ring-shaped body.

As the optimization of any technical solution or any optimized technical solution provided by the forgoing or later descriptions of the present application, the reducing support ring for a bridge plug is made from a degradable material or a corrodible material.

As the optimization of any technical solution or any optimized technical solution provided by the forgoing or later descriptions of the present application, the reducing support ring for a bridge plug has a ductility of greater than 5%.

As the optimization of any technical solution or any optimized technical solution provided by the forgoing or later descriptions of the present application, the corrosion rate of the material of the reducing support ring in a solution containing 0.5% of potassium chloride at 70° C. is greater than 0.1 $mg/cm^2 \cdot hr$.

As the optimization of any technical solution or any optimized technical solution provided by the forgoing or later descriptions of the present application, the reducing support ring for a bridge plug further includes at least one third ring-shaped body which overlaps the first ring-shaped body and the second ring-shaped body, wherein a third setting surface is provided on a circumferential outer wall or an end face of the third ring-shaped body; the deformations of the first ring-shaped body, the second ring-shaped body and the third ring-shaped body under the action of an axial compression force allow the setting surfaces of the first ring-shaped body, the second ring-shaped body and the third ring-shaped body to be all abutted against and positioned on the inner wall of the sleeve where the bridge plug is located, and to form the surface contact-type sealed connection with the inner wall of the sleeve.

A bridge plug provided by an embodiment of the present application includes a release sub, an elastic sealing cylinder, a slip platen, and two reducing support rings, with at least one of the two reducing support rings being the reducing supporting ring provided by any technical solution of the present application, wherein the elastic sealing cylinder, the slip platen and the two reducing support rings sleeve the release sub;

the elastic sealing cylinder is located between the two reducing support rings; and the reducing support ring is able to be positioned on an inner wall of a sleeve where the bridge plug is located under the action of axial compression forces exerted by the slip platen and the elastic sealing cylinder.

As the optimization of any technical solution or any optimized technical solution provided by the forgoing or later descriptions of the present application, an end face of the slip platen, compressing the reducing support ring, is flat surface, and the flat surface is perpendicular to the axial direction of the reducing support ring; a gap for accommodating the deformation of the reducing support ring is provided between the slip platen and a section of the circumferential outer wall of the reducing support ring, close to the slip platen.

As the optimization of any technical solution or any optimized technical solution provided by the forgoing or later descriptions of the present application, the bridge plug further includes a compression ring and slip assembly sleeving the release sub, wherein the slip assembly is located between the compression ring and the slip platen; the slip assembly includes a circumferential band and at least two slips; the circumferential band sleeves the slips; a guide structure is disposed between the slip and the compression ring; when the corresponding compression ring exerts an axial pressure on the slips, all the slips synchronously slide to be anchored at positions of the inner wall of the sleeve where the bridge plug is located from positions close to an axis of the release sub by means of the guide structures.

As the optimization of any technical solution or any optimized technical solution provided by the forgoing or later descriptions of the present application, the compression ring is connected to the release sub by means of thread structure with the connecting force adjustable; and/or, each guide structure includes a wedge-shaped surface provided on one of the corresponding slip and the compression ring, and a linear groove formed on the other one of the corresponding slip and the compression ring, wherein the bottom surface of each linear groove is a slope surface, and the wedge-shaped surface is abutted against the corresponding slope surface in relative sliding manner.

As the optimization of any technical solution or any optimized technical solution provided by the forgoing or later descriptions of the present application, each slip includes a tooth base and an anchoring tooth element, wherein each slip is anchored on the inner wall of the sleeve by means of the anchoring tooth element;

a mounting groove is formed on the tooth base; the anchoring tooth element is embedded in the mounting groove, and the bottom surface of the anchoring tooth element is abutted against a bottom surface of the mounting groove; the bottom surface of anchoring tooth element is capable of partially converting a frictional force on the anchoring tooth element in an axial direction of the release sub during anchoring into pressure in a radial direction of the release sub.

As the optimization of any technical solution or any optimized technical solution provided by the forgoing or later descriptions of the present application, the bottom surface of the anchoring tooth element is a flat surface or a curved surface, and a center line of the curved surface or the flat surface forms an acute angle or obtuse angle with a central axis of the release sub.

As the optimization of any technical solution or any optimized technical solution provided by the forgoing or later descriptions of the present application, the anchoring tooth element is located at position, close to the compression ring, of the tooth base, and/or the anchoring tooth element is gradually increased in thickness in a direction toward the corresponding compression ring.

As the optimization of any technical solution or any optimized technical solution provided by the forgoing or later descriptions of the present application, the release sub, the elastic sealing cylinder, the compression ring, the circumferential band and the tooth bases are made from a degradable material or a corrodible material.

As the optimization of any technical solution or any optimized technical solution provided by the forgoing or later descriptions of the present application, a check valve is disposed at an outer port, close to a formation exit, of the release sub, and the check valve includes a plugger and an anti-disengaging ring, wherein the plugger plugs the outer port of the release sub in a single direction and is capable of preventing a fluid from flowing into an internal fluid channel of the release sub from the outer port of the release sub in a direction away from the formation exit; and the anti-disengaging ring is detachably connected to the release sub and is capable of preventing the plugger from disengaging from the outer port of the release sub.

As the optimization of any technical solution or any optimized technical solution provided by the forgoing or later descriptions of the present application, the check valve further includes a protection ring (which is preferably made from a degradable material or a corrodible material) which abuts against the outer port of the release sub and has better degradation resistance or corrosion resistance than the release sub;

the plugger plugs on an inner wall of the protection ring and is capable of plugging a central through hole of the protection ring to prevent a fluid from flowing into the internal fluid channel of the release sub in the direction away from the formation exit; and the anti-disengaging ring is detachably connected to the release sub and is capable of locking the position of the protection ring and preventing the plugger from disengaging from the protection ring.

As the optimization of any technical solution or any optimized technical solution provided by the forgoing or later descriptions of the present application, a stopping flange is disposed on the inner wall of the anti-disengaging ring, and abuts against the protection ring to lock the protection ring at a position against the outer port of the release sub.

As the optimization of any technical solution or any optimized technical solution provided by the forgoing or later descriptions of the present application, an anti-disengaging flange or anti-disengaging pin is disposed on the anti-disengaging ring and is capable of preventing the plugger from disengaging from the outer port of the release sub.

As the optimization of any technical solution or any optimized technical solution provided by the forgoing or later descriptions of the present application, the anti-disengaging ring and the plugger are made from a degradable material or a corrodible material.

As the optimization of any technical solution or any optimized technical solution provided by the forgoing or later descriptions of the present application, the bridge plug comprises a first corrodible material or a second corrodible material, wherein the first corrodible material comprises the following components: 5-10 wt % of Al, 0.1-3 wt % of Zn, 0.01-1 wt % of Mn, 0.01-1 wt % of Sn, 0.05-5 wt % of Cu, 0.01-1.9 wt % of Pb, 0.01-5 wt % of Fe, 0.01-1 wt % of Si and the balance of Mg, with the sum of weight percentages of the components being 100 wt %;

the second corrodible material comprises the following components: 2-7.8 wt % of Mg, 0.01-4 wt % of Cu, 0.01-2 wt % of Sn, 0.01-9 wt % of Zn, 0.1-4.5 wt % of Ga, 0.01-1 wt % of Mn, 0.1-4.5 wt % of In, 0.01-3 wt % of Fe and the balance of Al, with the sum of weight percentages of the components being 100 wt %.

As the optimization of any technical solution or any optimized technical solution provided by the forgoing or later descriptions of the present application, a process for preparing the first corrodible material or the second corrodible material includes the following steps:

step A of smelting and casting: weighing the components according to designed alloy component proportions, warming the components for melting, followed by refining and casting;

step B of aftertreatment: performing heat treatment on a cast ingot obtained from the first step, including homogenizing annealing, quenching, aging treatment or deformation treatment (including squeezing, forging, rolling and the like).

As the optimization of any technical solution or any optimized technical solution provided by the forgoing or later descriptions of the present application, the smelting in step A is vacuum smelting or inert gas shielded smelting.

As the optimization of any technical solution or any optimized technical solution provided by the forgoing or later descriptions of the present application, when the first corrodible material is prepared, step A includes the following steps:

carrying out vacuum smelting or inert gas shielded smelting according to certain proportions to obtain an intermediate alloy C of the first corrodible material, wherein the intermediate alloy C of the first corrodible material includes aluminum, manganese, iron, silicon and copper;

smelting pure magnesium, pure aluminum, pure tin, pure zinc and pure lead through inert gas shielded smelting or vacuum smelting process, and then adding the intermediate alloy C of the first corrodible material;

and/or when the second corrodible material is prepared, step A includes the following steps:

carrying out vacuum smelting or inert gas shielded smelting according to certain proportions to obtain an intermediate alloy D of the second corrodible material, wherein the intermediate alloy D of the second corrodible material includes aluminum, copper, manganese and iron;

smelting pure magnesium, pure gallium, pure aluminum, pure tin, pure zinc and pure indium through inert gas shielded smelting or vacuum smelting process, and then adding the intermediate alloy D of the second corrodible material.

As the optimization of any technical solution or any optimized technical solution provided by the forgoing or later descriptions of the present application, the first corrodible material satisfies the following properties:

a compressive strength of above 400 MPa at room temperature, and a corrosion rate of greater than 0.2 mg/cm$^2$·hr at 70° C. and in a 0.5% potassium chloride solution; and/or, the second corrodible material satisfies the following properties:

a compressive strength of above 320 MPa at room temperature, and a corrosion rate of greater than 0.1 mg/cm$^2$·hr at 70° C. and in a solution containing 0.5% of potassium chloride.

On the basis of the above technical solutions, the embodiments of the present application may produce at least the following technical effects:

the deformation of the ring-shaped body in the reducing support ring for a bridge plug in the present application under the action of the axial compression force allows the setting surface of the ring-shaped body to be abutted against and positioned on the inner wall of the sleeve where the bridge plug is located, and to form surface contact-type sealed connection with the inner wall of the sleeve (or the well wall if conditions allow). The surface contact-type sealed connection is not only large in contact area, not prone to the issue of stress concentration at joints and high in structural reliability, but also more ideal and stable in sealing effect. As a result, the technical problem of unstable plugging effect in the prior art is solved.

In addition, it needs to be noted that many technical effects (lasting and stable plugging effect, good anchoring reliability, avoidance of midway setting, no requirement on plug drilling, convenient construction and the like) which can be produced by preferred technical solutions among many technical solutions provided by the present application will be described in detail below.

BRIEF DESCRIPTION OF THE DRAWINGS

Accompanying drawings described herein are intended for providing further understanding of the present application and form part of the present application. The schematic embodiments of the present application and descriptions thereof are meant to explain, rather than inappropriately limiting, the present application. In the accompanying drawings.

Figure 1:
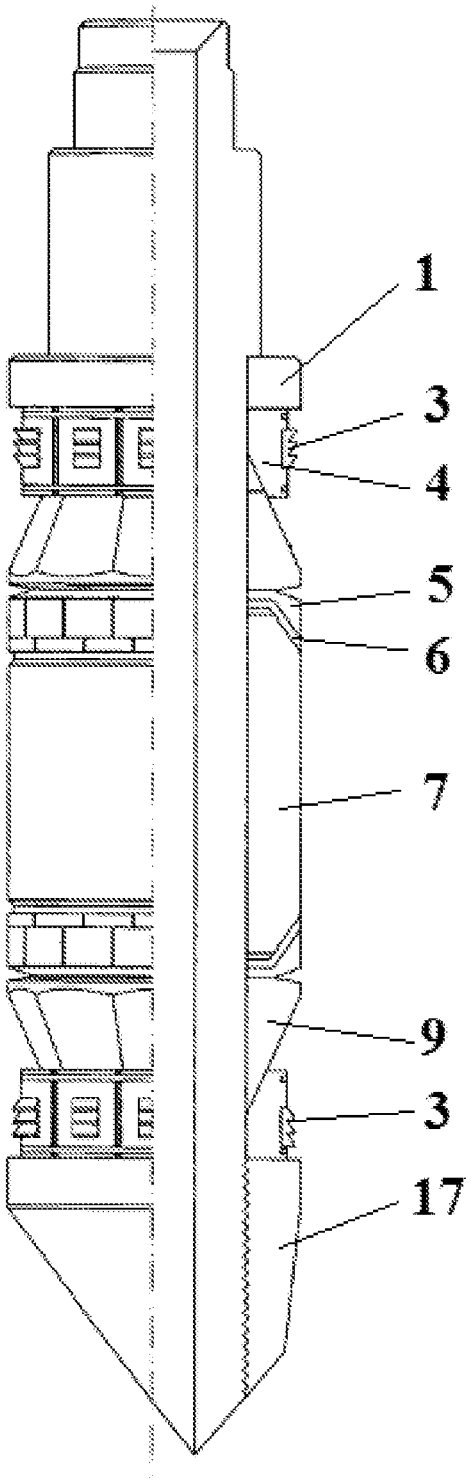
Fig. 1 PRIOR ART
FIG. 1 is a schematic diagram of a bridge plug provided in the prior art.
Figure 2:
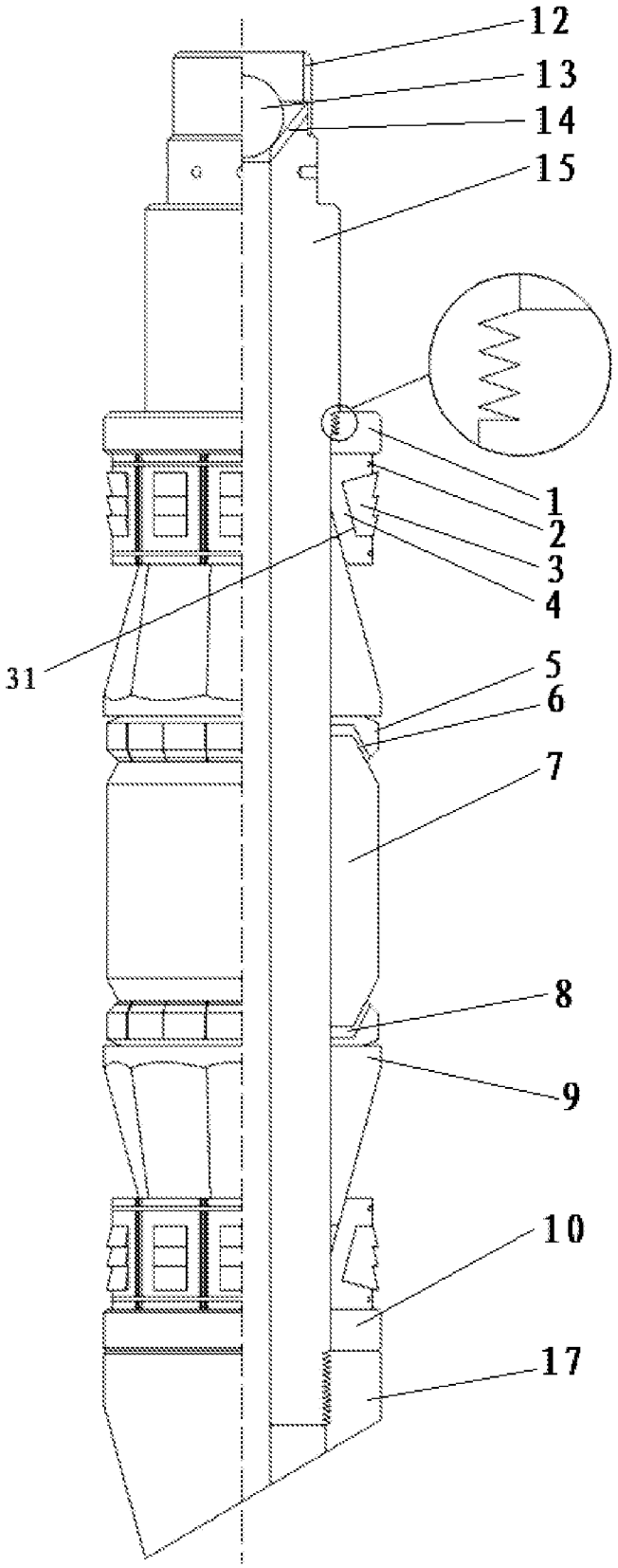
FIG. 2 is a schematic diagram of a bridge plug provided by an embodiment of the present application.
Figure 3:
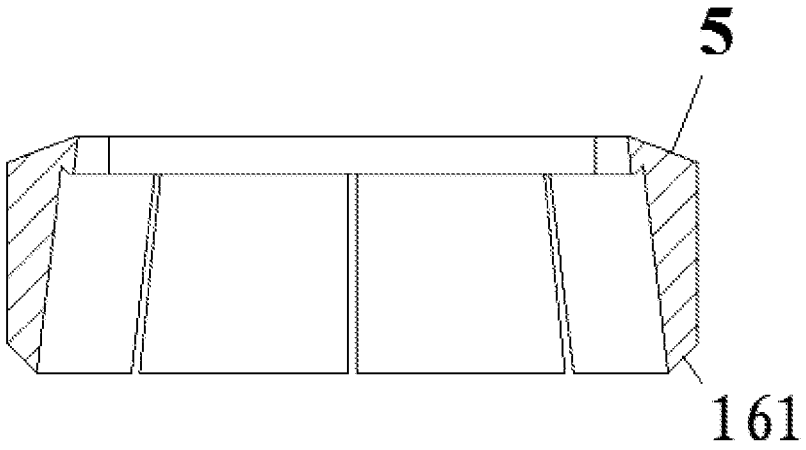
FIG. 3 is a sectional schematic diagram of a first ring-shaped body of a reducing support ring in a bridge plug provided by an embodiment of the present application.

Reference numerals: 1, compression ring (located upstream); 2, circumferential band; 3, anchoring tooth element; 31, bottom surface of the anchoring tooth element; 4, tooth base; 5, first ring-shaped body; 6, second ring-shaped body (belonging to an upper reducing support ring); 7, elastic sealing cylinder; 8, second ring-shaped body (belonging to a lower reducing support ring); 9, slip platen (or referred to as slip body); 10, compression ring (located downstream); 101, groove; 102, slope surface; 103, wedge-shaped surface; 11, anti-disengaging pin; 12, anti-disengaging ring; 121, stopping flange; 13, plugger; 14, protection ring; 15, release sub (the position indicated by the reference numeral is the part thereof close to a formation exit); 161, first setting surface; 162, second setting surface; 17, downstream-end support.

DETAILED DESCRIPTION OF THE EMBODIMENTS

Understanding of the contents of the present application and the points of distinction of the present application with the prior art will be provided below with reference to FIG. 1 to FIG. 14 and the text. The technical solutions (including the preferred technical solutions) of the present application will be further described in detail by means of the accompanying drawings and by showing some optional embodiments of the present application. It needs to be noted that any technical feature or any technical solution in these embodiments is one or more of a plurality of optional technical features or optional technical solutions; for the sake of simple descriptions, all the alternative technical features and alternative technical solutions of the present application cannot be all listed in this document, and it is also not convenient for emphasis on that the implementation of every technical feature is one of a plurality of optional implementations; therefore, a person skilled in the art will understand that any technical means provided by the present application can be substituted or any two or more technical means or technical features provided by the present application can be combined to reach a new technical solution. Any technical feature and any technical solution in these embodiments do not limit the protection scope of the present application. The protection scope of the present application should cover any alternative technical solution which can be conceived of by a person skilled in the art without creative work and any new technical solution obtained by a person skilled in the art combining any two or more technical means or technical features provided by the present application.

An embodiment of the present application provides a reducing support ring for a bridge plug which has the advantages of lasting and stable plugging effect, good anchoring reliability, avoidance of midway setting, no requirement on plug drilling, convenient construction and the like, and a bridge plug using the reducing support ring.

The technical solutions provided by the present application will be elaborated in more details in conjunction with FIG. 1 to FIG. 14.

As shown in FIG. 2 to FIG. 14, a reducing support ring for a bridge plug provided by the embodiments of the present application includes ring-shaped bodies and setting surfaces (preferably including a first setting surface 161 and a second setting surface 162) provided on the circumferential outer walls or end faces of the ring-shaped bodies. The deformations of the ring-shaped bodies under the action of the axial compression force allow the setting surfaces of the ring-shaped bodies to be abutted against and positioned on the inner wall of a sleeve where the bridge plug is located, and to form surface contact-type sealed connection with the inner wall of the sleeve (or the well wall if conditions allow).

The deformations of the ring-shaped bodies in the reducing support ring for a bridge plug in the present application under the action of the axial compression force allow the setting surfaces of the ring-shaped bodies to be abutted against and positioned on the inner wall of the sleeve where the bridge plug is located, and to form surface contact-type sealed connection with the inner wall of the sleeve (or the well wall if conditions allow). The surface contact-type sealed connection is not only large in contact area, not prone to the issue of stress concentration at joints and high in structural reliability, but also more ideal and stable in sealing effect.

In addition, it needs to be noted that many technical effects (lasting and stable plugging effect, good anchoring reliability, avoidance of midway setting, no requirement on plug drilling, convenient construction and the like) which can be produced by preferred technical solutions among many technical solutions provided by the present application will be elaborated in detail below.

Figure 4:
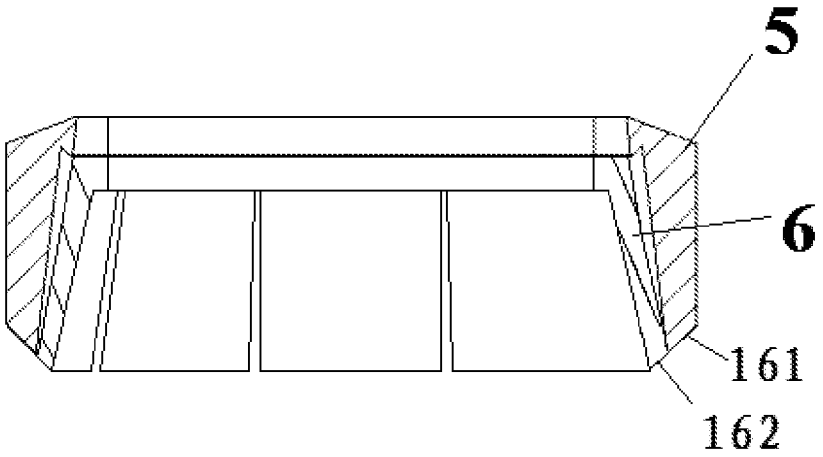
FIG. 4 is a sectional schematic diagram of overlapping first and second ring-shaped bodies in a reducing support ring in a bridge plug provided by an embodiment of the present application.
Figure 5:
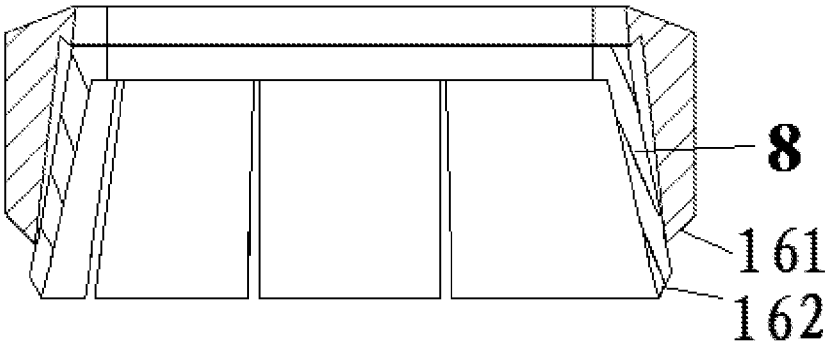
FIG. 5 is a sectional schematic diagram of overlapping first and second ring-shaped bodies in another reducing support ring in a bridge plug provided by an embodiment of the present application.

As an optional implementation, the reducing support ring includes a first ring-shaped body 5 and a second ring-shaped body 6 overlapping each other, wherein as shown in FIG. 4 and FIG. 5, the setting surfaces include a first setting surface 161 provided on a circumferential outer wall or an end face of the first ring-shaped body 5 and a second setting surface 162 provided on a circumferential outer wall or an end face of the second ring-shaped body 6; the deformations of the first ring-shaped body 5 and the second ring-shaped body 6 under the action of an axial compression force allow the first setting surface of the first ring-shaped body and the second setting surface of the second ring-shaped body to be abutted against and positioned on the inner wall of the sleeve where the bridge plug is located, and to form the surface contact-type sealed connection with the inner wall of the sleeve.

The first ring-shaped body and the second ring-shaped body are complementary with each other, and support and fit with each other to achieve a better sealing effect. As an optional implementation, before the first ring-shaped body 5 and the second ring-shaped body 6 are compressed, the first setting surface and/or the second setting surface are/is a conical surface or a curved surface, and preferably a conical surface. When the setting surface of such a structure is positioned on the inner wall of the sleeve where the bridge plug is located, its fitting area with the inner wall of the sleeve is large, not easily causing stress concentration around, and therefore, a lasting and stable plugging effect can be achieved.

As an optional implementation, the respective sections of the first ring-shaped body 5 and the second ring-shaped body 6, sleeving an elastic sealing cylinder 7 of the bridge plug, are provided with at least two gaps, or at least two weak areas which are split to form gaps after the deformations of the first ring-shaped body and the second ring-shaped body. Each section is divided by the respective gaps into at least two forked branches provided in a circumferential direction, and the corresponding setting surface is located on the circumferential outer walls of the forked branches. The forked branches are stronger in elasticity, and also more uniform in abutting force in its setting region with the inner wall of the sleeve in the circumferential direction with a more ideal sealing effect.

As an optional implementation, the gaps or weak areas in the first ring-shaped body 5 and the gaps or weak areas in the second ring-shaped body 6 are staggered with each other in the circumferential direction. In this case, when the elastic sealing cylinder 7 is fractured, the scraps of the elastic sealing cylinder 7 can be prevented from infiltrating and passing through the reducing support ring.

As an optional implementation, each gap or weak area in the first ring-shaped body 5 is located at a central position in the circumferential direction between two adjacent gaps or weak areas in the second ring-shaped body 6. With such a structure, when the elastic sealing cylinder 7 is fractured, the scraps of the elastic sealing cylinder 7 can be more effectively prevented from infiltrating and passing through the reducing support ring.

As an optional implementation, the reducing support ring is made from a degradable material or a corrodible material. The reducing support ring is degraded or corroded fast after the completion of the formation fracturing operation, with a plug drilling process omitted. In addition, in case of failure in setting, the reducing support ring may also be degraded or corroded naturally before the setting of a new bridge plug; therefore, the construction is convenient.

As an optional implementation, the first setting surface on the first ring-shaped body 5 is flush with the second setting surface on the second ring-shaped body 6, and when the two ring-shaped bodies are positioned on the inner wall of the sleeve where the bridge plug is located, the two are flush with each other in the axial direction. If setting under this circumstance, a more ideal sealing effect can be achieved.

As an optional implementation, the ductility of the reducing support ring is greater than 5%. Preferably, the ductility of the reducing support ring is greater than 7%. In this case, the reducing support ring is good in elasticity, not prone to damage, and more ideal in persistence of the setting and sealing effects.

As an optional implementation, the material of the reducing support ring comprises the following components: 2-7.8 wt % of Mg, 0.01-4 wt % of Cu, 0.01-2 wt % of Sn, 0.01-9 wt % of Zn, 0.1-4.5 wt % of Ga, 0.01-1 wt % of Mn, 0.1-4.5 wt % of In, 0.01-3 wt % of Fe and the balance of Al, with the sum of weight percentages of the components being 100 wt %. The reducing support ring made according to the above material component proportions may well meet the requirements of reservoir fracturing and exploration of oil and gas in degradability, corrodibility, strength and hardness. Certainly, the above disclosed material component proportions are merely preferred component proportions of the present application, and a person skilled in the art can make alterations to part or all of the elements and the weight percentages of the elements. Moreover, in addition to the reducing support ring of the bridge plug, the above material may also be applied to making other parts.

As an optional implementation, the reducing support ring for a bridge plug further includes at least one third ring-shaped body which overlaps the first ring-shaped body 5 and the second ring-shaped body 6, wherein a third setting surface is provided on a circumferential outer wall or end face of the third ring-shaped body; the deformations of the first ring-shaped body 5, the second ring-shaped body 6 and the third ring-shaped body under the action of an axial compression force allow the first setting surface of the first ring-shaped body, the second setting surface of the second ring-shaped body and the third setting surface of the third ring-shaped body to be all abutted against and positioned on the inner wall of the sleeve where the bridge plug is located, and to form the surface contact-type sealed connection with the inner wall of the sleeve. The third ring-shaped body can be provided according to the actual requirement of setting, or not provided; when provided, one or more third ring-shaped bodies may be designed according to requirements.

A bridge plug provided by an embodiment of the present application includes a release sub 15, an elastic sealing cylinder 7, slip platens 9, and two reducing support rings, with at least one (preferably both) of the two reducing support rings being the reducing supporting ring provided by any technical solution of the present application, wherein the elastic sealing cylinder 7, the slip platens 9 and the two reducing support rings all sleeve the release sub 15;

the elastic sealing cylinder 7 is located between the two reducing support rings; and the reducing support rings can be positioned on an inner wall of a sleeve where the bridge plug is located under the action of axial compression forces exerted by the slip platens 9 and the elastic sealing cylinder 7.

The reducing supporting ring provided by the present application is suitable for use in the bridge plug to improve the plugging effect and setting performance thereof, and in particular to ensure a lasting and stable plugging effect.

As an optional implementation, end faces of the slip platens 9, compressing the reducing support rings, are flat surfaces, and the flat surfaces are perpendicular to the axial direction of the reducing support rings; gaps for accommodating the deformations of the reducing support rings are provided between the slip platens 9 and sections of the circumferential outer walls of the reducing support rings, close to the slip platens 9.

Such a structure is conducive to effective deformation of the reducing support ring at a predetermined position by using the compressive force of the slip platen 9 without damage due to excessive deformation and the issue of unstable setting, thus achieving more lasting and stable setting in the sleeve.

Figure 6:
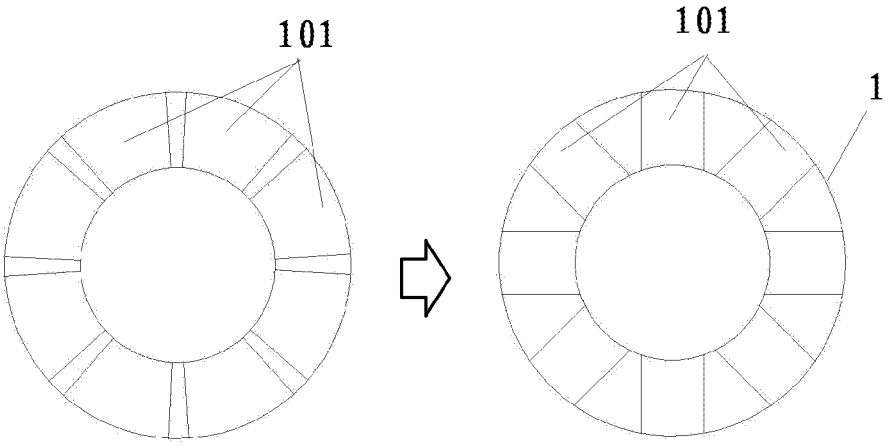
FIG. 6 is a contrastive schematic diagram of a compression ring provided with linear grooves and a compression ring provided with fan-shaped grooves in a bridge plug provided by an embodiment of the present application.

As an optional implementation, the bridge plug further includes a compression ring 1 as shown in FIG. 6 (or compression ring 10, with the compression ring 1 as an example below), and a slip assembly, both of which sleeve the release sub 15, wherein the slip assembly is located between the compression ring 1 and the corresponding slip platen 9;

the slip assembly includes circumferential bands 2 and at least two slips; the circumferential bands 2 sleeves the slips; a guide structure is disposed between each slip and the compression ring 1; when the compression ring 1 exerts an axial pressure on the slips, all the slips synchronously slide to be anchored at positions of the inner wall of the sleeve where the bridge plug is located from positions close to an axis of the release sub 15 by means of the guide structures.

The slips in the slip assembly are moved to the anchoring positions from the initial position invariably in the centering state, thus ensuring the reliability of anchoring. As a result, the bridge plug may not go down during fracturing, thereby avoiding the issue of failure of zoning and further ensuring quite ideal quality of zonal fracturing construction.

As an optional implementation, the compression ring 1 is connected to the release sub 15 by means of a thread structure with adjustable connecting force. Certainly, a pin may also be used for connection. The thread structure with adjustable connecting force is better in applicability to allow for adjustment of the connecting force between the compression ring 1 and the release sub 15 by way of changing the number of engaged threads between the compression ring 1 and the release sub 15 according to actual situations. When the release sub 15 is pulled by the mandrel of a plug running tool, and the outer cylinder of the plug running tool moves downwards and exerts pressure on the compression ring 1, the pressure may cause a failure in the connection structure between the compression ring 1 and the release sub 15. After the failure of the connection structure, the compression ring 1 may go down and exert an axial pressure on the slips.

Figure 7:
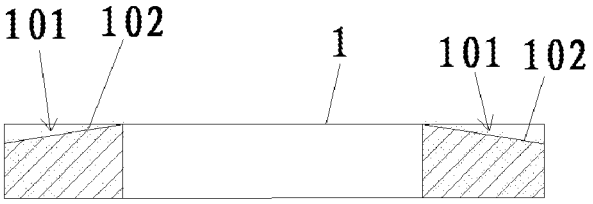
FIG. 7 is a sectional schematic diagram of a compression ring provided with linear grooves in a bridge plug provided by an embodiment of the present application.
Figure 8:
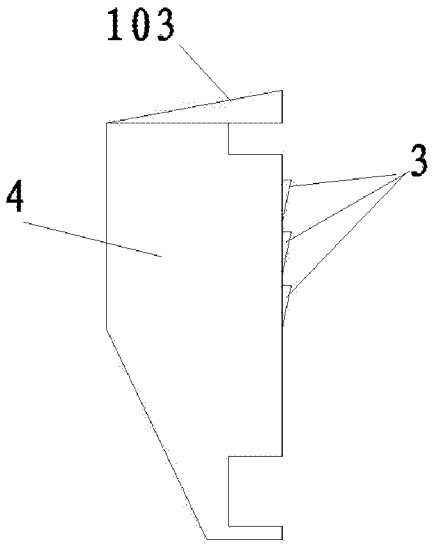
FIG. 8 is a principal schematic diagram of a slip composed of a tooth base and an anchoring tooth element in a bridge plug provided by an embodiment of the present application.

As an optional implementation, the guide structure includes a wedge-shaped surface 103 provided on one of the corresponding slip and the compression ring 1 (preferably on the slip, and specifically on the tooth base 4 of the slip) as shown in FIG. 8, and linear grooves 101 (those grooves having identical width with the length direction as a linear direction) formed on the other one of the corresponding slip and the compression ring 1 (preferably on the compression ring 1) as shown in FIG. 6 and FIG. 7, wherein the bottom surface of each linear groove 101 is a slope surface 102, and the wedge-shaped surface 103 is abutted against the corresponding slope surface 102 in such a manner of being capable of sliding relatively. The above structure ideally achieves the centering function of the slips in the slip assembly by means of the sliding performance between the wedge-shaped surfaces 103 and the slope surfaces 102 and the limiting action of the linear grooves 101 in the sliding process. The centering performance of the linear grooves 101 may be far better than that of fan-shaped grooves.

Figure 9:
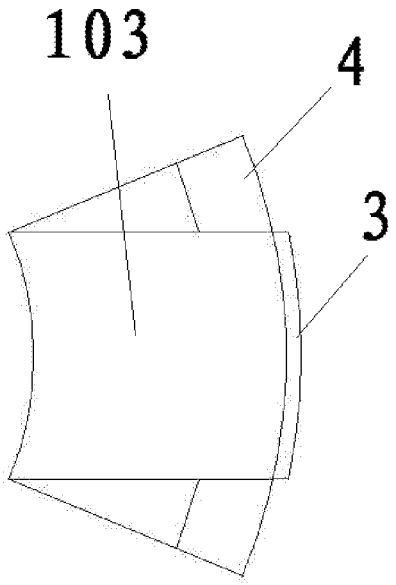
FIG. 9 is a top schematic diagram of the slip as shown in FIG. 8.
Figure 10:
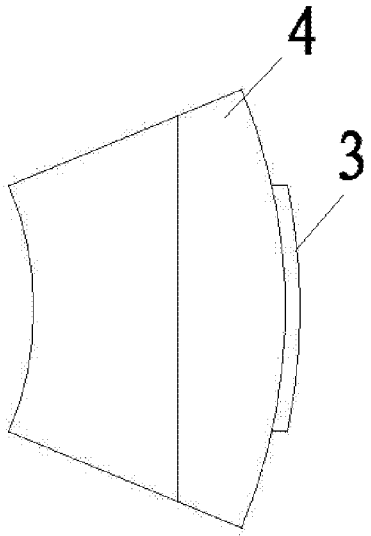
FIG. 10 is an bottom schematic diagram of the slip as shown in FIG. 8.
Figure 11:
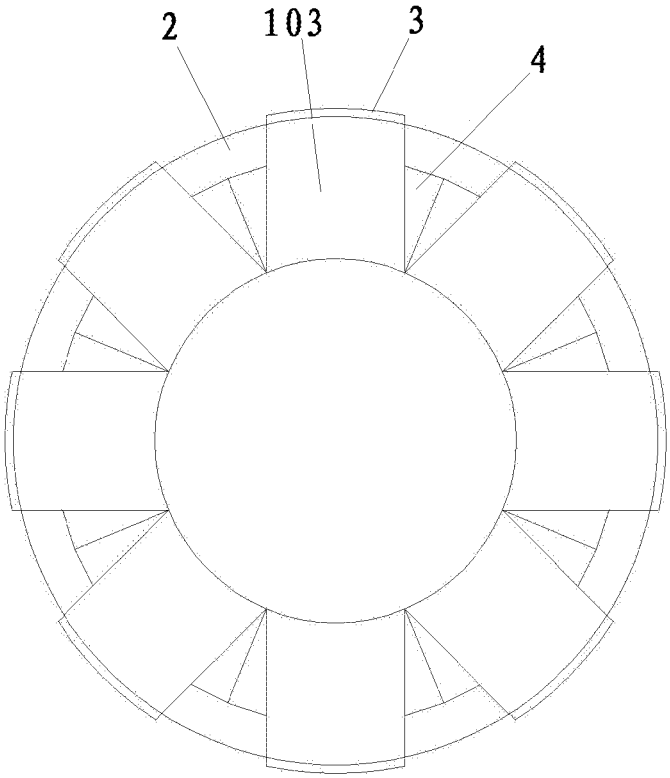
FIG. 11 is a schematic diagram of eight tooth bases assembled with two circumferential bands in a bridge plug provided by an embodiment of the present application in a view from top to bottom in an axial direction (in a direction leading to the well bottom)
Figure 12:
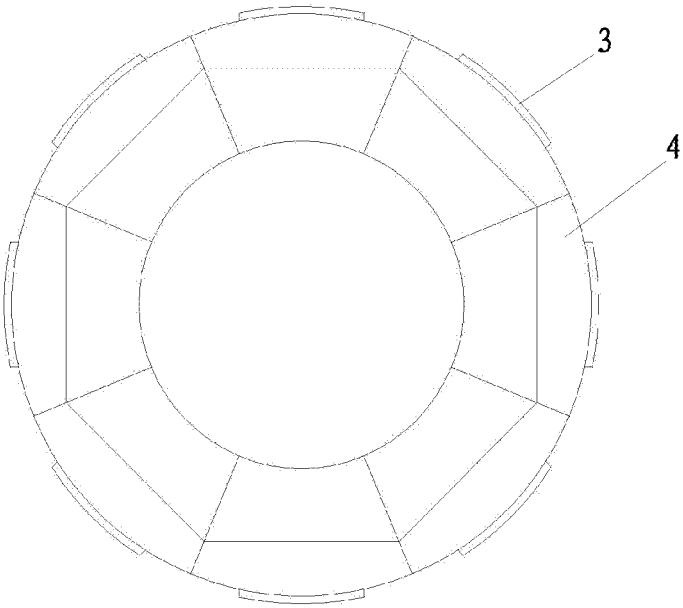
FIG. 12 is a schematic diagram of eight tooth bases assembled with two circumferential bands in a bridge plug provided by an embodiment of the present application in a view from bottom to top in an axial direction (in a direction leading to the well opening)
Figure 13:
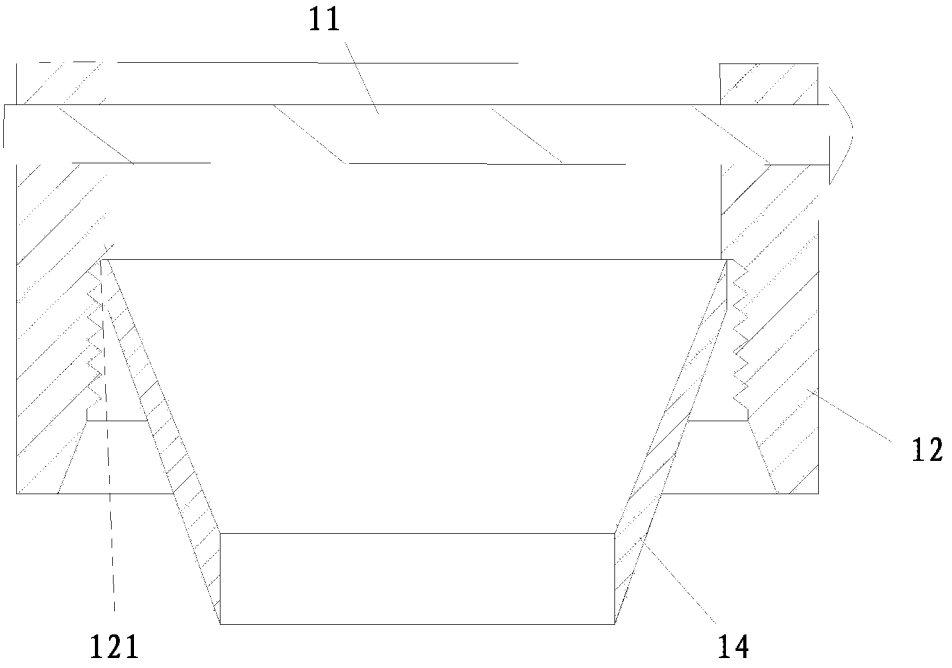
FIG. 13 is a sectional schematic diagram of an assembly of an anti-disengaging ring and a protection ring in a bridge plug provided by an embodiment of the present application when the protection ring is limited by the anti-disengaging ring.
Figure 14:
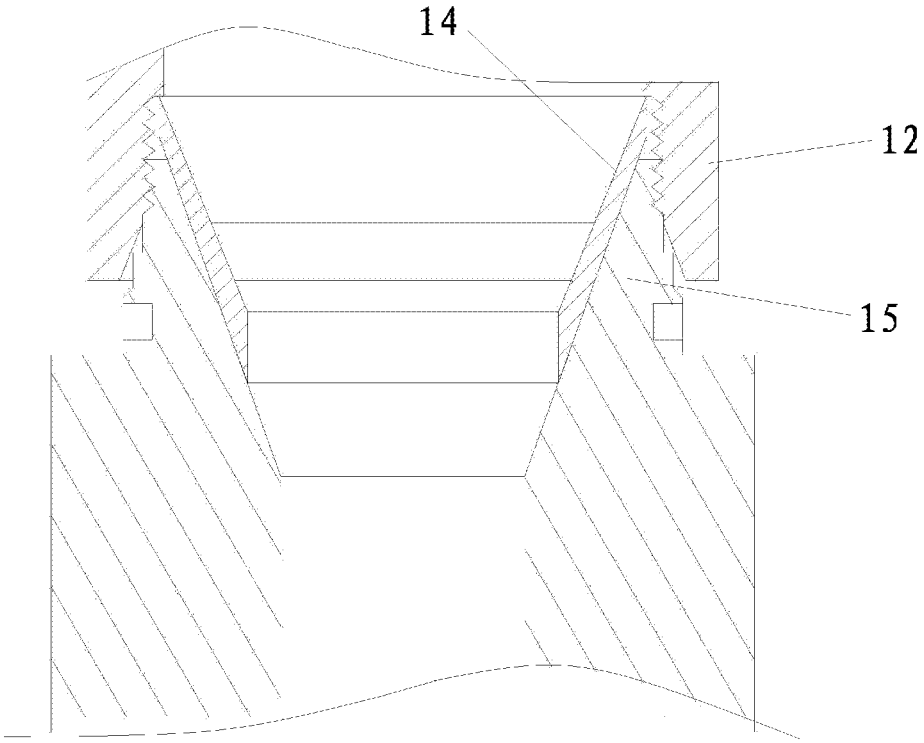
FIG. 14 is a partial sectional schematic diagram of an assembly of a protection ring and an anti-disengaging ring with a release sub in a bridge plug provided by an embodiment of the present application when the protection ring is limited by the anti-disengaging ring.

The wedge-shaped surface 103 as shown in FIG. 8 and FIG. 9 and the slope surface 102 as shown in FIG. 7 in this embodiment may specifically be flat surfaces, or matching surface structures matching with each other (e.g., a concave surface matching with a convex surface, a wrinkle surface matching with a wrinkle surface) or guide rail structures.

As shown in FIG. 8 to FIG. 12, as an optional implementation, each slip includes a tooth base 4 and an anchoring tooth element 3, wherein, each slip is anchored on the inner wall of the sleeve by means of the anchoring tooth element 3.

A mounting groove is formed on the tooth base 4; the anchoring tooth element 3 is embedded into the mounting groove, and the bottom surface 31 of the anchoring tooth element 3 are abutted against a bottom surface of the mounting groove; the bottom surface 31 of each anchoring tooth element 3 is capable of partially converting a frictional force on the anchoring tooth element 3 in an axial direction of the release sub 15 during anchoring into pressure in a radial direction of the release sub 15.

In such a structure, as the bottom surface 31 of each anchoring tooth element 3 is capable of decomposing at least part of the axial frictional force on the outer surface of the anchoring tooth element 3 by way of conversion, the service life of the anchoring tooth element 3 is prolonged and the working reliability thereof is improved. The volume of each anchoring tooth element 3 is far smaller than that of the tooth base 4. Preferably, each anchoring tooth element 3 is higher than the anchoring base 4 in hardness, and may be specifically made from ceramics. After other parts of the bridge plug are corroded or degraded thoroughly, the anchoring tooth element 3 will fall into the sleeve in the form of broken ceramic particles.

As an optional implementation, the bottom surface 31 of each anchoring tooth element 3 is a flat surface or a curved surface, and a center line of the curved surface or the flat surface forms an acute angle or an obtuse angle with a central axis of the release sub 15. In such a structure, the flat surface or the curved surface is a regular surface, which is convenient to machine, manufacture and assemble. Certainly, the technical solutions of replacing the flat surface or the curved surface with other curved surfaces should also fall into the protection scope of the present application.

As an optional implementation, the anchoring tooth element 3 is located at position, close to the compression ring 1, of the tooth base 4, and/or the anchoring tooth element 3 is gradually increased in thickness in a direction toward the compression ring 1.

When the anchoring tooth element 3 is located at the position, close to the compression ring 1, of the tooth base 4, the section, compressing the anchoring tooth element 3, of the tooth base 4 is relatively thick and higher in strength, and therefore, it is conducive to prolonging the service life of the tooth base 4 and improving the working reliability thereof. When the anchoring tooth element 3 is gradually increased in thickness in the direction toward the compression ring 1, it is conducive to improving the compressive property of the anchoring tooth element 3, and prolonging the service life thereof and enhancing the working reliability thereof.

As an optional implementation, the release sub 15, the elastic sealing cylinder 7, the compression ring 1, the circumferential band 2 and the tooth base 4 are made from a degradable material or a corrodible material.

Similar to the reducing support ring, apart from the anchoring tooth element 3 which is small in size and which will be cracked, other parts of the bridge plug can all be degraded or corroded naturally after the completion of the formation fracturing operation, so that the plug drilling process can be omitted. In addition, in case of failure in setting, the parts of the bridge plug may be degraded or corroded naturally before the setting of a new bridge plug; therefore, the construction is convenient.

As an optional implementation, a check valve is disposed at an outer port, close to a formation exit, of the release sub 15, and the check valve includes a plugger 13 (which is preferably a ball, and may also be referred to as a plugging ball when it is a ball) and an anti-disengaging ring 12, wherein the plugger 13 plugs the outer port of the release sub 15 in a single direction and is capable of preventing a fluid from flowing into an internal fluid channel of the release sub 15 from the outer port of the release sub 15 in a direction away from the formation exit; and the anti-disengaging ring 12 is detachably connected to the release sub 15 and is capable of preventing the plugger 13 from disengaging from the outer port of the release sub 15.

As an optional implementation, the check valve further includes a protection ring 14 which is made from a degradable material or a corrodible material, abuts against the outer port of the release sub 15 and has better degradation resistance or corrosion resistance than the release sub 15.

The plugger 13 plugs on an inner wall of the protection ring 14 and is capable of plugging a central through hole of the protection ring 14 to prevent a fluid from flowing into the internal fluid channel of the release sub 15 in the direction away from the formation exit through the central through hole of the protection ring 14.

The anti-disengaging ring 12 is detachably connected (which is preferably in threaded connection) to the release sub 15 and is capable of locking the position of the protection ring 14 and preventing the plugger 13 from disengaging from the protection ring 14.

The protection ring 14 may protect the outer port of the release sub 15, thus increasing the degradation or corrosion rate of the outer port of the release sub 15 and improving the reliability of the check valve. The protection ring 14 is more material-saving, which is conducive to cost reduction.

As an optional implementation, a stopping flange 121 is disposed on the inner wall of the anti-disengaging ring 12, and abuts against the protection ring 14 to lock the protection ring 14 at a position against the outer port of the release sub 15. The anti-disengaging ring 12 is capable of locking, limiting and preventing disengaging of the protection ring 14.

As an optional implementation, an anti-disengaging flange (which may be specifically formed by a shoulder on the inner wall of the anti-disengaging ring 12, or a retainer ring detachably connected to the anti-disengaging ring 12) or an anti-disengaging pin 11 is disposed on the anti-disengaging ring 12 and is capable of preventing the plugger 13 from disengaging from the outer port of the release sub 15. The anti-disengaging flange or anti-disengaging pin 11 is capable of limiting and locking the plugger 13. The anti-disengaging pin 11 and the anti-disengaging ring 12 may form a cage structure for preventing the plugging ball from dropping out.

As an optional implementation, the anti-disengaging ring 12 and the plugger 13 are made from a degradable material or a corrodible material. The check valve may become invalid after the degradation or corrosion of the anti-disengaging ring 12 and the plugger 13, and subsequently, the petroleum extraction operation can be carried out.

In the present application, the structure at position of the check valve has three forms:

1, the release sub 15 is made from a material relatively low in degradation or corrosion rate without the protection ring 14, and only the anti-disengaging flange is provided on the anti-disengaging ring 12 without the anti-disengaging pin 11;

2, the release sub 15 is made from a material relatively high in degradation or corrosion rate, the protection ring 14 made from a material relatively low in degradation or corrosion rate is provided, and no anti-disengaging pin 11 is provided on the anti-disengaging ring 12;

3, the release sub 15 is made from a material relatively high in degradation or corrosion rate, the protection ring 14 made from a material relatively low in degradation or corrosion rate is provided, and the anti-disengaging pin 11 is provided on the anti-disengaging ring 12.

As an optional implementation, part or all of the parts of the bridge plug are made from a first corrodible material or a second corrodible material, wherein the first corrodible material comprises the following components: 5-10 wt % of Al, 0.1-3 wt % of Zn, 0.01-1 wt % of Mn, 0.01-1 wt % of Sn, 0.05-5 wt % of Cu, 0.01-1.9 wt % of Pb, 0.01-5 wt % of Fe, 0.01-1 wt % of Si and the balance of Mg, with the sum of weight percentages of the components being 100 wt %;

the second corrodible material comprises the following components: 2-7.8 wt % of Mg, 0.01-4 wt % of Cu, 0.01-2 wt % of Sn, 0.01-9 wt % of Zn, 0.1-4.5 wt % of Ga, 0.01-1 wt % of Mn, 0.1-4.5 wt % of In, 0.01-3 wt % of Fe and the balance of Al, with the sum of weight percentages of the components being 100 wt %.

The parts of the bridge plug made according to the above material component proportions may well meet the requirements of reservoir fracturing and exploration of oil and gas in degradability, corrodibility, strength and hardness. Certainly, the above disclosed material component proportions are merely preferred component proportions of the present application, and a person skilled in the art can make alterations to part or all of the elements and the weight percentages of the elements. Moreover, the above material may also be applied to making other parts than the bridge plug parts.

As an optional implementation, a process for preparing the first corrodible material or the second corrodible material includes the following steps:

step A of smelting and casting: weighing the components according to designed alloy component proportions, warming the components for melting, followed by refining and casting;

step B of aftertreatment: performing heat treatment on a cast ingot obtained from the first step, including homogenizing annealing, quenching, aging treatment or deformation treatment (including squeezing, forging, rolling and the like).

As an optional implementation, smelting in step A is vacuum smelting or inert gas shielded smelting.

As an optional implementation, step A includes the following steps:

carrying out vacuum smelting or inert gas shielded smelting according to certain proportions to obtain an intermediate alloy C of the first corrodible material, wherein the intermediate alloy C of the first corrodible material comprises aluminum, manganese, iron, silicon and copper;

during vacuum smelting or inert gas shielded smelting, smelting pure magnesium, pure aluminum, pure tin, pure zinc and pure lead first for the first corrodible material, and then adding the intermediate alloy C;

As an optional implementation, step A includes the following steps:

carrying out vacuum smelting or inert gas shielded smelting according to certain proportions to obtain an intermediate alloy D of the second corrodible material, wherein the intermediate alloy D of the second corrodible material comprises aluminum, copper, manganese and iron;

during vacuum smelting or inert gas shielded smelting, smelting pure magnesium, pure gallium, pure aluminum, pure tin, pure zinc and pure indium first for the second corrodible material, and then adding the intermediate alloy D.

The intermediate alloy is relatively high in melting point and low in content, and later addition thereof is conducive to either control on the components of alloying elements or thorough utilization of the smelting equipment and saving of energy sources.

As an optional implementation, the first corrodible material satisfies the following properties:

a compressive strength of above 400 MPa at room temperature, and a corrosion rate of greater than 0.2 $mg/cm^2 \cdot hr$ at 70° C. and in a 0.5% potassium chloride solution; and/or, the second corrodible material satisfies the following properties:

a compressive strength of above 320 MPa at room temperature, and a corrosion rate of greater than 0.1 $mg/cm^2 \cdot hr$ at 70° C. and in a solution containing 0.5% of potassium chloride.

Experiments prove that during oil and gas reservoir fracturing and oil and gas exploitation, the degradability, corrodibility, strength and hardness of the material of making the above reducing support ring may ideally meet the requirements of most formations and the sleeve where the bridge slug is located. Certainly, a person skilled in the art can also make appropriate alterations to the properties of the material of the reducing support ring according to the conditions of the formations actually needing to be fractured and the strength and hardness of the sleeve where the bridge plug is located.

The tooth bases 4 of the slips and the protection ring 14 in the present application are preferably made from the first corrodible material, and other parts, apart from the anchoring tooth element 3 and the elastic sealing cylinder 7, may all be made from the second corrodible material.

If any technical solution disclosed by the present application above discloses a numerical area, the disclosed numerical area is a preferred numerical area unless otherwise stated. Any person skilled in the art should understand that the preferred numerical area is merely values having relatively obvious technical effects or being representative among many practical values. Due to numerous values which cannot be all listed, the present application discloses only part of the values to illustrate the technical solutions of the present application; in addition, the above listed values will not limit the protection scope of the present invention and creations.

If such words as "first" and "second" are used herein to define the parts, a person skilled in the art will understand that the use of "first" and "second" is merely intended for differentiating the parts in descriptions, and the above words have no special meanings unless otherwise stated.

Furthermore, if the present application discloses or involves parts or structural members in fixed connection to each other above, unless otherwise stated, the fixed connection may be interpreted as detachable fixed connection (e.g., connection by using a bolt or a screw), or may be interpreted as undetachable fixed connection (e.g., riveting and welding). Certainly, fixed connection to each other may also be replaced by an integrated structure (e.g., made by integral forming through the casting process) (except the case in which the integral forming process cannot be used apparently).

In addition, the terms for indicating position relationships or shapes used in any technical solution disclosed by the present application above have the meanings including those states or shapes approximate, similar or close to these terms unless otherwise stated. Any part provided by the present application may be assembled with a plurality of independent components, or may be an independent part made through the integral forming process.

If the terms "center", "longitudinal", "transverse", "front", "back", "left", "right", "vertical", "horizontal", "top", "bottom", "inside", "outside", "up", "down" and the like are used in the descriptions of the present application, the orientations or position relationships indicated by these terms are the orientations or position relationships based on the accompanying figures, which are just for the purposes of convenient descriptions and simplified descriptions of the present application rather than indicating or implying that the mentioned equipment, mechanisms, parts or elements must have specific orientations, and be constructed and manipulated in specific orientations; therefore, they cannot be interpreted as limitations to the protection scope of the present application.

Finally, it should be noted that the above embodiments are merely intended for describing, rather than limiting, the technical solutions of the present application. Although the present application is described in detail with reference to the preferred embodiment, a person of ordinary skill in the art will understand that modifications can still be made to the specific implementations of the present application or equivalent substitutions may be made to part of the technical features; and these modifications or equivalent substitutions do not deviate from the spirit of the technical solutions of the present application and should all fall into the protection scope of the technical solutions set forth in the present application.

The invention claimed is:

1. A bridge plug comprising a release sub, an elastic sealing cylinder, a slip platen, and a reducing support ring, wherein the elastic sealing cylinder, the slip platen and the reducing support ring sleeve the release sub, wherein the reducing support ring comprises a ring-shaped body, a setting surface is provided on a circumferential outer wall or an end face of the ring-shaped body, a deformation of the ring-shaped body under the action of an axial compression force allows the setting surface of the ring-shaped body to be abutted against and positioned on an inner wall of a sleeve where the bridge plug is located, and to form surface contact-type sealed connection with the inner wall of the sleeve, wherein the reducing support ring is able to be positioned on an inner wall of a sleeve where the bridge plug is located under the action of axial compression forces exerted by the slip platens and the elastic sealing cylinder, and wherein an end face of the slip platen, compressing the reducing support ring, is a flat surface, and the flat surface is perpendicular to an axial direction of the reducing support rings, and a gap for accommodating the deformation of the reducing support ring is provided between the slip platen and a section of the circumferential outer wall of the reducing support ring, close to the slip platen.

2. The bridge plug according to claim 1, further comprising a compression ring and a slip assembly sleeving the release sub, wherein the slip assembly is located between the compression ring and the slip platen, and wherein the slip assembly comprises a circumferential band and at least two slips, the circumferential band sleeves the slips, a guide structure is disposed between the slips and the compression ring, and when the compression ring exerts an axial pressure on the slips, all of the slips synchronously slide to be anchored at positions of the inner wall of the sleeve where the bridge plug is located from positions close to an axis of the release sub by means of the guide structures.

3. The bridge plug according to claim 2, wherein the compression ring is connected to the release sub by means of a threaded structure with adjustable connecting force; and/or wherein each guide structure comprises a wedge-shaped surface provided on one of the corresponding slip and the compression ring, and a linear groove formed on the other one of the corresponding slip and the compression ring, and wherein the bottom surface of each linear groove is a slope surface, and the wedge-shaped surface is abutted against the corresponding slope surface in relative sliding manner.

4. The bridge plug according to claim 2, wherein each slip comprises a tooth base and an anchoring tooth element, wherein the slip is anchored on the inner wall of the sleeve by means of the anchoring tooth element, and wherein a mounting groove is formed on the tooth base, the anchoring tooth element is embedded into the mounting groove, and the bottom surface of the anchoring tooth element is abutted against a bottom surface of the mounting groove, and wherein the bottom surface of the anchoring tooth element is capable of partially converting a frictional force on the anchoring tooth element in an axial direction of the release sub during anchoring into pressure in a radial direction of the release sub.

5. The bridge plug according to claim 4, wherein the bottom surface of each anchoring tooth element is a flat surface or a curved surface, and a center line of the curved surface or the flat surface forms an acute angle or an obtuse angle with the central axis of the release sub.

6. The bridge plug according to claim 4, wherein the anchoring tooth element is located at a position, close to the compression ring, of the tooth base, or the anchoring tooth element is gradually increased in thickness in a direction toward the compression ring.

7. The bridge plug according to claim 4, wherein the release sub, the elastic sealing cylinder, the compression ring, the circumferential band and the tooth bases are made from a degradable material or a corrodible material.

8. The bridge plug according to claim 1, wherein a check valve is disposed at an outer port, close to a formation exit, of the release sub, and the check valve comprises a plugger and an anti-disengaging ring, and wherein the plugger plugs the outer port of the release sub in a single direction and is capable of preventing a fluid from flowing into an internal fluid channel of the release sub from the outer port of the release sub in a direction away from the formation exit, and the anti-disengaging ring is detachably connected to the release sub and is capable of preventing the plugger from disengaging from the outer port of the release sub.

9. The bridge plug according to claim 8, wherein the check valve further comprises a protection ring which abuts against the outer port of the release sub and has better degradation resistance or corrosion resistance than the release sub, wherein the plugger plugs on an inner wall of the protection ring and is capable of plugging a central through hole of the protection ring to prevent a fluid from flowing into the internal fluid channel of the release sub in the direction away from the formation exit through the central through hole of the protection ring, and wherein the anti-disengaging ring is detachably connected to the release sub and is capable of locking the position of the protection ring and preventing the plugger from disengaging from the protection ring.

10. The bridge plug according to claim 9, wherein the anti-disengaging ring and the plugger are made from a degradable material or a corrodible material.

11. The bridge plug according to claim 1, wherein the bridge plug comprises a first corrodible material or a second corrodible material, wherein the first corrodible material comprises the following components: 5-10 wt % of Al, 0.1-3 wt % of Zn, 0.01-1 wt % of Mn, 0.01-1 wt % of Sn, 0.05-5 wt % of Cu, 0.01-1.9 wt % of Pb, 0.01-5 wt % of Fe, 0.01-1 wt % of Si and the balance of Mg, with the sum of weight percentages of the components being 100 wt %, and wherein the second corrodible material comprises the following components: 2-7.8 wt % of Mg, 0.01-4 wt % of Cu, 0.01-2 wt % of Sn, 0.01-9 wt % of Zn, 0.1-4.5 wt % of Ga, 0.01-1 wt % of Mn, 0.1-4.5 wt % of In, 0.01-3 wt % of Fe and the balance of Al, with the sum of weight percentages of the components being 100 wt %.

12. The bridge plug according to claim 11, wherein the first corrodible material satisfies the following properties:

a compressive strength of above 400 MPa at room temperature, and a corrosion rate of greater than 0.2 $mg/cm^2 \cdot hr$ at 70° C. and in a 0.5% potassium chloride solution, or the second corrodible material satisfies the following properties:

a compressive strength of above 320 MPa at room temperature, and a corrosion rate of greater than 0.1 $mg/cm^2 \cdot hr$ at 70° C. and in a solution containing 0.5% of potassium chloride.

13. The bridge plug according to claim 1, wherein the reducing support ring comprises a first ring-shaped body and a second ring-shaped body overlapping each other, wherein a first setting surface is provided on the circumferential outer wall or an end face of the first ring-shaped body and a second setting surface is provided on the circumferential outer wall or an end face of the second ring-shaped body, and wherein the deformations of the first ring-shaped body and the second ring-shaped body under the action of an axial compression force allow the first setting surface of the first ring-shaped body and the second setting surface of the second ring-shaped body to be abutted against and positioned on the inner wall of the sleeve where the bridge plug is located, and to form the surface contact-type sealed connection with the inner wall of the sleeve.

14. The bridge plug according to claim 13, wherein the first setting surface and/or the second setting surface are/is a conical surface or a curved surface before the first ring-shaped body and the second ring-shaped body are compressed.

15. The bridge plug according to claim 13, wherein respective sections of the first ring-shaped body and the second ring-shaped body sleeving an elastic sealing cylinder of the bridge plug are provided with at least two gaps, or at least two weak areas which are split to form gaps after the first ring-shaped body and the second ring-shaped body are compressed, wherein each section is divided by the respective gaps into at least two forked branches provided in a circumferential direction, and the first setting surface and/or the second setting surface are/is located on circumferential outer walls or end faces of the forked branches, and wherein the gaps or weak areas in the first ring-shaped body and the gaps or weak areas in the second ring-shaped body are staggered with each other in the circumferential direction.

16. The bridge plug according to claim 1, wherein the reducing support ring is made from a degradable material or a corrodible material.

17. The bridge plug according to claim 1, wherein the reducing support ring has a ductility of greater than 5%.

18. The bridge plug according to claim 1, wherein the corrosion rate of the material of the reducing support ring in a solution containing 0.5% of potassium chloride at 70° C. is greater than 0.1 $mg/cm^2 \cdot hr$.

* * * * *